US011705050B2

(12) United States Patent
Byeon et al.

(10) Patent No.: US 11,705,050 B2
(45) Date of Patent: Jul. 18, 2023

(54) POWER MANAGEMENT INTEGRATED CIRCUIT AND ITS DRIVING METHOD

(71) Applicant: LX Semicon Co., Ltd., Daejeon (KR)

(72) Inventors: Jin Su Byeon, Daejeon (KR); Cheol Ho Lee, Daejeon (KR)

(73) Assignee: LX SEMICON CO., LTD., Daejeon (KR)

( * ) Notice: Subject to any disclaimer, the term of this patent is extended or adjusted under 35 U.S.C. 154(b) by 0 days.

(21) Appl. No.: 17/820,850

(22) Filed: Aug. 18, 2022

(65) Prior Publication Data

US 2023/0058571 A1 Feb. 23, 2023

(30) Foreign Application Priority Data

Aug. 19, 2021 (KR) ..... 10-2021-0109223

(51) Int. Cl.
*G09G 3/20* (2006.01)

(52) U.S. Cl.
CPC ... *G09G 3/2096* (2013.01); *G09G 2300/0857* (2013.01); *G09G 2310/0267* (2013.01); *G09G 2310/08* (2013.01); *G09G 2330/021* (2013.01)

(58) Field of Classification Search
None
See application file for complete search history.

(56) References Cited

U.S. PATENT DOCUMENTS

2007/0146290 A1* 6/2007 Hirama ..... G11C 19/28 345/100
2007/0171179 A1* 7/2007 Morosawa ..... G09G 3/3685 345/100

FOREIGN PATENT DOCUMENTS

KR 10-0804628 B1 2/2008
KR 2017-0015691 A 2/2017
KR 2018-0024912 A 3/2018

* cited by examiner

*Primary Examiner* — Chad M Dicke
(74) *Attorney, Agent, or Firm* — Polsinelli PC

(57) ABSTRACT

A power management integrated circuit includes a flip-flop circuit configured to perform a logic operation on a start clock signal which sets a driving start time point of a gate driving circuit and an on-clock signal which sets an output start time point of the gate driving circuit; a first AND gate circuit configured to receive one among output signals of the flip-flop circuit and the start clock signal, to perform an AND logic operation thereon, and to generate a gate start signal; and a second AND gate circuit configured to receive the other of the output signals of the flip-flop circuit and the start clock signal, to perform an AND logic operation thereon, and to generate a gate reset signal.

20 Claims, 10 Drawing Sheets

463

POWER MANAGEMENT INTEGRATED CIRCUIT AND ITS DRIVING METHOD

CROSS REFERENCE TO RELATED APPLICATION

This application claims priority from Republic of Korea Patent Application No. 10-2021-0109223 filed on Aug. 19, 2021, which is hereby incorporated by reference in its entirety.

BACKGROUND

1. Field of Technology

The present disclosure relates to a power management integrated circuit for driving a panel of a display device and a display device including the same.

2. Description of the Prior Art

A display device may include a panel capable of displaying an image or sensing a touch by each pixel, a data driving circuit and a gate driving circuit which drive the panel, and a timing controller which controls the driving of each of the data driving circuit and the gate driving circuit.

The timing controller may transmit a gate control signal for the gate driving circuit to control the supply of a scan signal for turning on or off a transistor located in each pixel, and may transmit a data control signal for the data driving circuit to control the supply of a data voltage to each pixel according to the scan signal supplied by the gate driving circuit.

A power management integrated circuit may supply power to components inside the display device, for example, the data driving circuit, the gate driving circuit and the timing controller, so that an electronic device can operate, and may receive the data control signal and the gate control signal generated by the timing controller to change the timing, magnitude and phase of signals transferred to the data driving circuit and the gate driving circuit.

The power management integrated circuit may be electrically connected to the components inside the display device through a processor and an interface to transfer a plurality of clock signals having preset voltages or currents to the components inside the display device.

Meanwhile, in the conventional power management integrated circuit, since a plurality of signal lines are formed according to kinds of gate control signals transferred from the timing controller to the power management integrated circuit, problems are caused in that the power consumption of the display device increases and electromagnetic noise between the plurality of signal lines increases.

Moreover, in the conventional power management integrated circuit, a gate start signal and a gate reset signal may be generated by combining some of gate control signals transferred from the timing controller. However, since signals to be combined, the gate start signal and the gate reset signal are interlocked, problems may be caused in that a plurality of signals are outputted through separate time periods and thus the driving time of the gate driving circuit increases.

SUMMARY OF THE INVENTION

Under such a background, various embodiments are directed to providing a power management integrated circuit including a combination circuit which generates a signal for controlling gate driving, through a logic operation without increasing kinds of gate control signals transmitted by a timing controller.

Various embodiments are directed to providing a power management integrated circuit which reduces the driving time of a gate driving circuit by designing an internal combination circuit to independently drive gate control signals, a gate start signal and a gate reset signal transferred to the power management integrated circuit.

In one aspect, an embodiment may provide a power management integrated circuit including: flip-flop circuit configured to perform a logic operation on a start clock signal which sets a driving start time point of a gate driving circuit and an on-clock signal which sets an output start time point of the gate driving circuit; a first AND gate circuit configured to receive one among output signals of the flip-flop circuit and the start clock signal, to perform an AND logic operation thereon, and to generate a gate start signal; and a second AND gate circuit configured to receive the other of the output signals of the flip-flop circuit and the start clock signal, to perform an AND logic operation thereon, and to generate a gate reset signal.

In another aspect, an embodiment may provide a power management integrated circuit including: a D flip-flop circuit configured to receive, through a first input port, an on-clock signal generated by a timing controller, to receive, through a second input port, a start clock signal generated by the timing controller, and to perform a logic operation thereon; a first AND gate circuit connected to a first output port of the D flip-flop circuit, and configured to output a gate start signal; and a second AND gate circuit connected to a second output port of the D flip-flop circuit, and configured to output a gate reset signal, wherein the D flip-flop circuit filters and outputs a pulse of an input signal through one inverter and four AND gate circuits disposed therein.

In still another aspect, an embodiment may provide a power management integrated circuit connected to a timing controller which generates a gate control signal, and configured to receive the gate control signal, wherein the gate control signal includes a start clock signal which is transferred to the power management integrated circuit through a start clock line, an on-clock signal which is transferred to the power management integrated circuit through an on-clock line, and an off-clock signal which is transferred to the power management integrated circuit through an off-clock line, and wherein the power management integrated circuit includes: a flip-flop circuit configured to perform a logic operation on the start clock signal and the on-clock signal for each time period; an AND gate circuit configured to perform a logic operation on an output signal of the flip-flop circuit and the start clock signal and to output a gate start signal; and a gate output stage circuit configured to receive an output signal of the AND gate circuit and to transfer a gate driving voltage to a gate line.

As is apparent from the above, according to the embodiments, a signal generated by a power management integrated circuit may be efficiently controlled, and the driving time of a gate driving circuit may be reduced.

According to the embodiments, the timing of a gate clock signal generated by the power management integrated circuit may be independently controlled through a logic operation inside the power management integrated circuit.

DETAILED DESCRIPTION OF THE EXEMPLARY EMBODIMENTS

Figure 1:
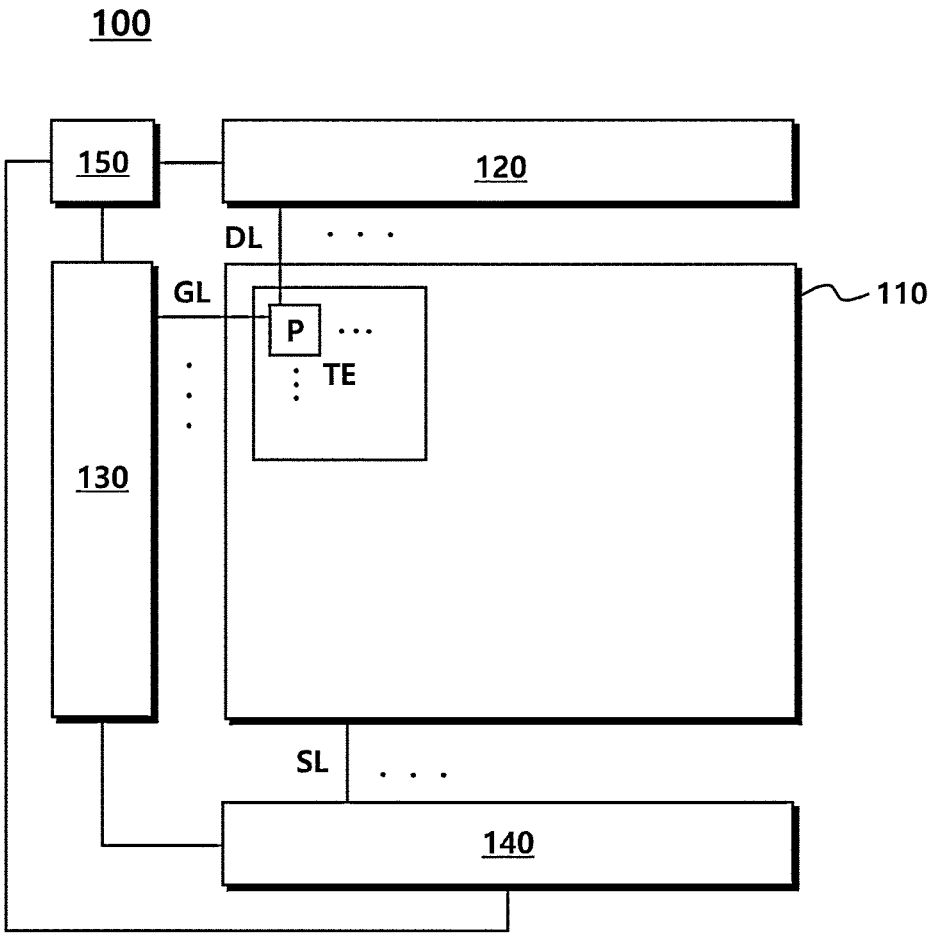
FIG. 1 is a configuration diagram of a display device.

FIG. 1 is a configuration diagram of a display device.

Referring to FIG. 1, a display device 100 may include a panel 110, a data driving circuit 120, a gate driving circuit 130, a touch sensing circuit 140 and a timing controller 150.

The panel 110 may be implemented in the form of a panel of a known type, such as a liquid crystal display panel (LCD panel), an organic light-emitting diode display panel (OLED panel) and so forth.

A plurality of data lines DL which are connected to the data driving circuit 120 and a plurality of gate lines GL which are connected to the gate driving circuit 130 may be formed in the panel 110. A plurality of pixels P corresponding to intersections of the plurality of data lines DL and the plurality of gate lines GL may be defined in the panel 110.

In each pixel P, a transistor, having a first electrode (e.g., a source electrode or a drain electrode) which is connected to the data line DL, a gate electrode which is connected to the gate line GL and a second electrode (e.g., a drain electrode or a source electrode) which is connected to a display electrode, may be formed.

The panel 110 may include a display panel and a touch screen panel (TSP), and the display panel and the touch screen panel may share some components.

The data driving circuit 120 may supply a data signal to the data line DL in order to display an image on each pixel P of the panel 110.

The data driving circuit 120 may include at least one data driving integrated circuit. The at least one data driving integrated circuit may be formed directly in the panel 110, or as the case may be, may be formed by being integrated into the panel 110. If necessary, the data driving circuit 120 may be defined as a source driver or a source driver integrated circuit.

The gate driving circuit 130 may sequentially supply a scan signal to the gate line GL in order to turn on or off the transistor located in each pixel P. When the scan signal of a turn-on voltage is supplied to the pixel P, the corresponding pixel P may be connected to the data line DL, and when the scan signal of a turn-off voltage is supplied to the pixel P, the connection between the corresponding pixel P and the data line DL may be released.

When the scan signal transferred from the gate driving circuit 130 is a gate high voltage VGH, the transistor may be turned on and thus a data voltage may be transferred to the pixel P through the data line DL, and when the scan signal is a gate low voltage VGL, the transistor may be turned off and a charged data voltage may be maintained.

The gate driving circuit 130 may be formed in a TAB (tape automated bonding) method of attaching a printed circuit board, on which a plurality of gate drive integrated circuits (GDIC) are mounted, to a display panel, or in a GIP (gate drive IC in panel) method of directly forming gate drive integrated circuits in a display panel.

The touch sensing circuit 140 may obtain touch sensing data by applying a driving signal to all or some of a plurality of touch electrodes TE which are connected to sensing lines SL.

The timing controller 150 may supply various control signals to the data driving circuit 120, the gate driving circuit 130 and the touch sensing circuit 140.

The timing controller 150 may transmit a data control signal (DCS) which controls the data driving circuit 120 to supply a data voltage to each pixel P, transmit a gate control signal (GCS) to the gate driving circuit 130 or transmit a sensing signal to the touch sensing circuit 140, in conformity with each timing. The timing controller 150 may further include a component other than a timing controller to additionally perform another control function.

The timing controller 150 may receive a timing signal such as a horizontal synchronization signal, a vertical synchronization signal and image data from a host (not illustrated) to generate the data control signal (DCS), the gate control signal (GCS) and so forth.

The gate control signal (GCS) may include a start clock signal (SCLK), an on-clock signal (ON_CLK), an off-clock signal (OFF_CLK), and so forth.

Figure 2:
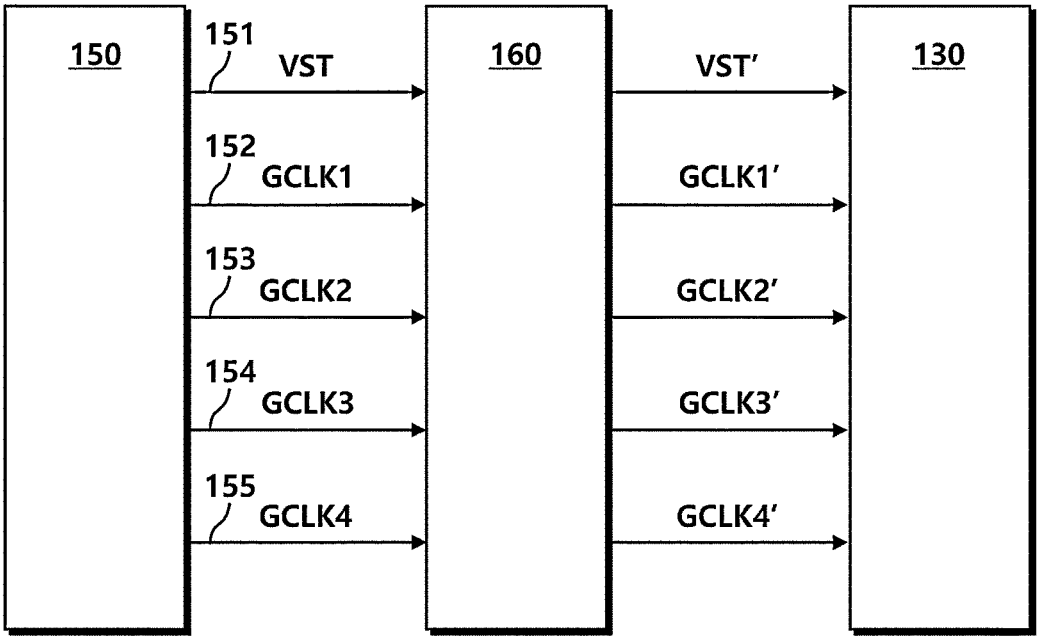
FIG. 2 is a flowchart for explaining kinds of gate control signals transferred from a timing controller to a power management integrated circuit.

FIG. 2 is a flowchart for explaining kinds of gate control signals transferred from a timing controller to a power management integrated circuit.

Referring to FIG. 2, the timing controller 150 may transfer a gate start signal VST and gate clock signals GCLK1 to GCLK4 to a power management integrated circuit 160, and the power management integrated circuit 160 may transfer the gate start signal VST and the gate clock signals GCLK1 to GCLK4 to the gate driving circuit 130.

The power management integrated circuit 160 may transfer signals received from the timing controller 150 to the gate driving circuit 130 as they are. On the other hand, the power management integrated circuit 160 may change the timing, phases and amplitudes of the signals, and may generate and transfer to the gate driving circuit 130 a changed gate start signal VST' and changed gate clock signals GCLK1' to GCLK4'.

Signal lines and communication ports may be formed between the timing controller 150 and the power management integrated circuit 160 as many as the number of signals to be transferred. For example, as illustrated in FIG. 2, five signal lines 151, 152, 153, 154 and 155 and five ports may be formed.

As the number of signal lines formed between the timing controller 150 and the power management integrated circuit 160 increases, the complexity of circuit design increases, and power loss through the signal lines and noise between the signal lines, for example, electromagnetic interference (EMI), increase. Thus, it is necessary to appropriately reduce the number of signal lines.

If necessary, the power management integrated circuit 160 and the gate driving circuit 130 may be configured as one integrated circuit, but may be configured as separate integrated circuits.

Figure 3:
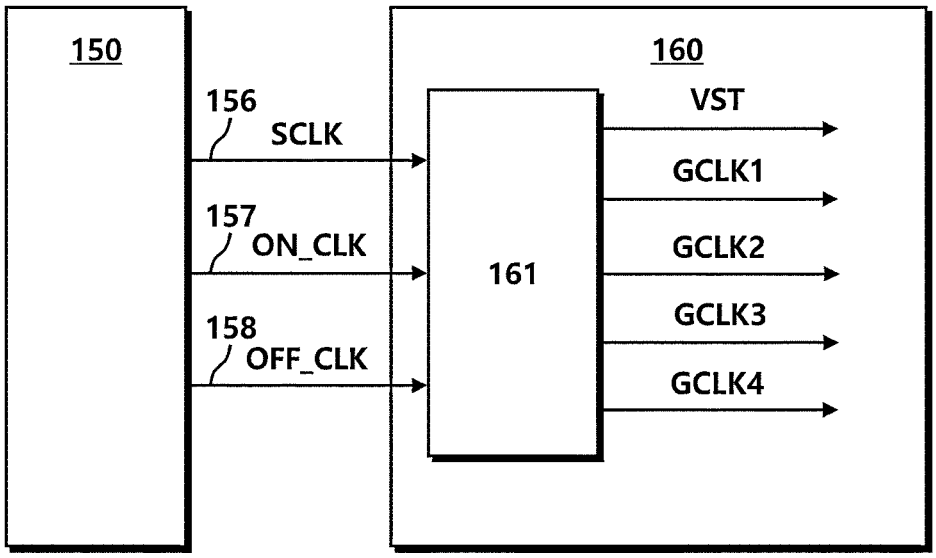
FIG. 3 is a first exemplary diagram for explaining the internal configuration of a power management integrated circuit in accordance with an embodiment.

FIG. 3 is a diagram for explaining the internal configuration of a power management integrated circuit in accordance with an embodiment.

Referring to FIG. 3, the timing controller 150 may transfer a start clock signal SCLK, an on-clock signal ON_CLK and an off-clock signal OFF_CLK to the power management integrated circuit 160 through respective signal lines 156, 157, 158, and the power management integrated circuit 160 may generate gate driving signals by combining the start clock signal SCLK, the on-clock signal ON_CLK and the off-clock signal OFF_CLK through a logic combination circuit 161 and transfer the gate driving signals to the gate driving circuit 130.

As illustrated in FIG. 3, when the kinds and number of signals transferred from the timing controller 150 are reduced and the power management integrated circuit 160 generates signals VST and GCLK1 to GCLK4 through logic operations, the number of signal lines or interfaces for signal transmission between the timing controller 150 and the power management integrated circuit 160 may be reduced, and the number of input/output pins formed between devices may be reduced.

Figure 4:
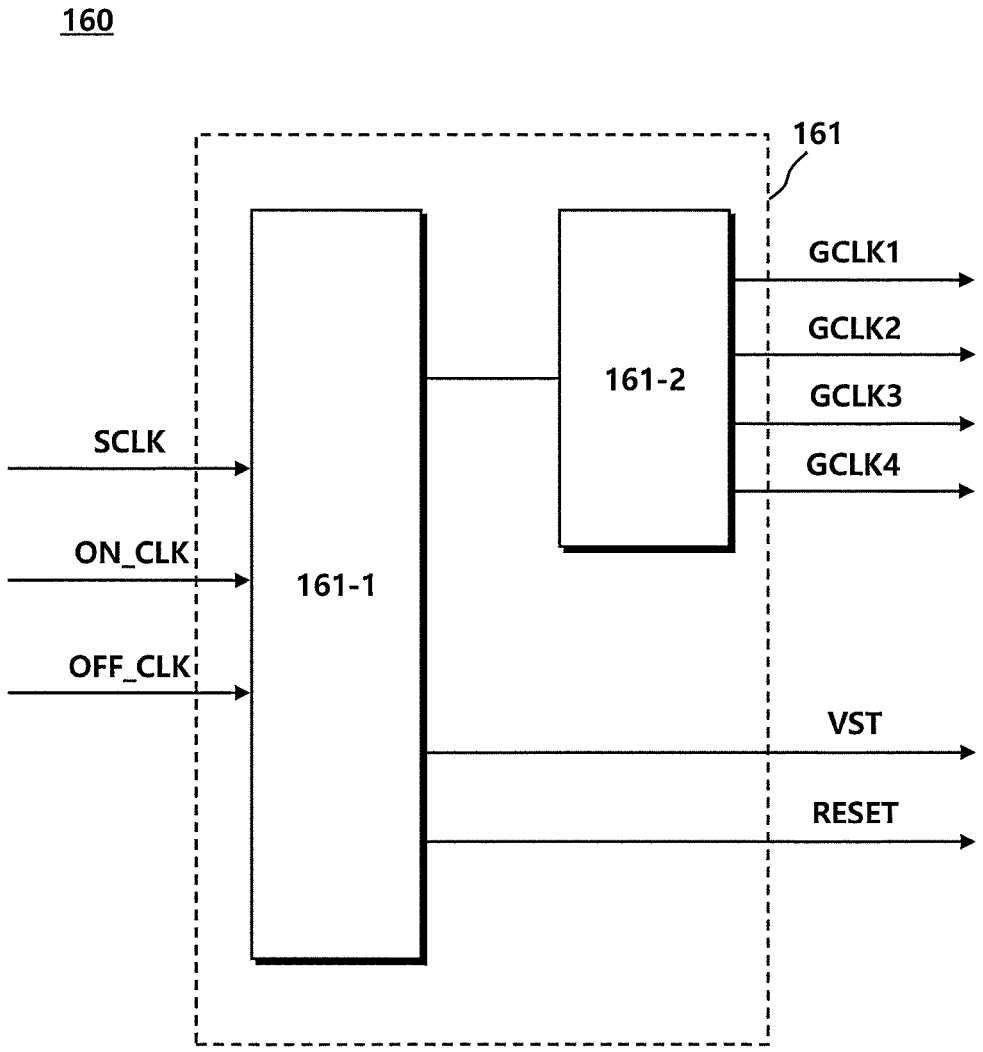
FIG. 4 is a second exemplary diagram for explaining the internal configuration of a power management integrated circuit in accordance with an embodiment.

FIG. 4 is a second exemplary diagram for explaining the internal configuration of a power management integrated circuit in accordance with an embodiment.

Referring to FIG. 4, the logic combination circuit 161 may include a logic circuit 161-1 and a gate clock generation circuit 161-2.

The logic circuit 161-1 may include a level shifter (LS) which may output an inputted signal by adjusting the level thereof, and may adjust the level of the signal before or after a logic operation therein.

The logic circuit 161-1 may receive the start clock signal SCLK, the on-clock signal ON_CLK and the off-clock signal OFF_CLK and output them as they are, or may output a gate start signal VST and a gate reset signal RESET through separate logic operations.

The gate clock generation circuit 161-2 may generate gate clock signals GCLK1 to GCLK4 by performing logic operations on the start clock signal SCLK, the on-clock signal ON_CLK and the off-clock signal OFF_CLK transferred from the logic circuit 161-1, but the kind and number of gate clock signals are not limited thereto. For example, the number of clock signals may be 4, but the number of clock signals may be variously adjusted to 6, 12, etc.

Figure 5:
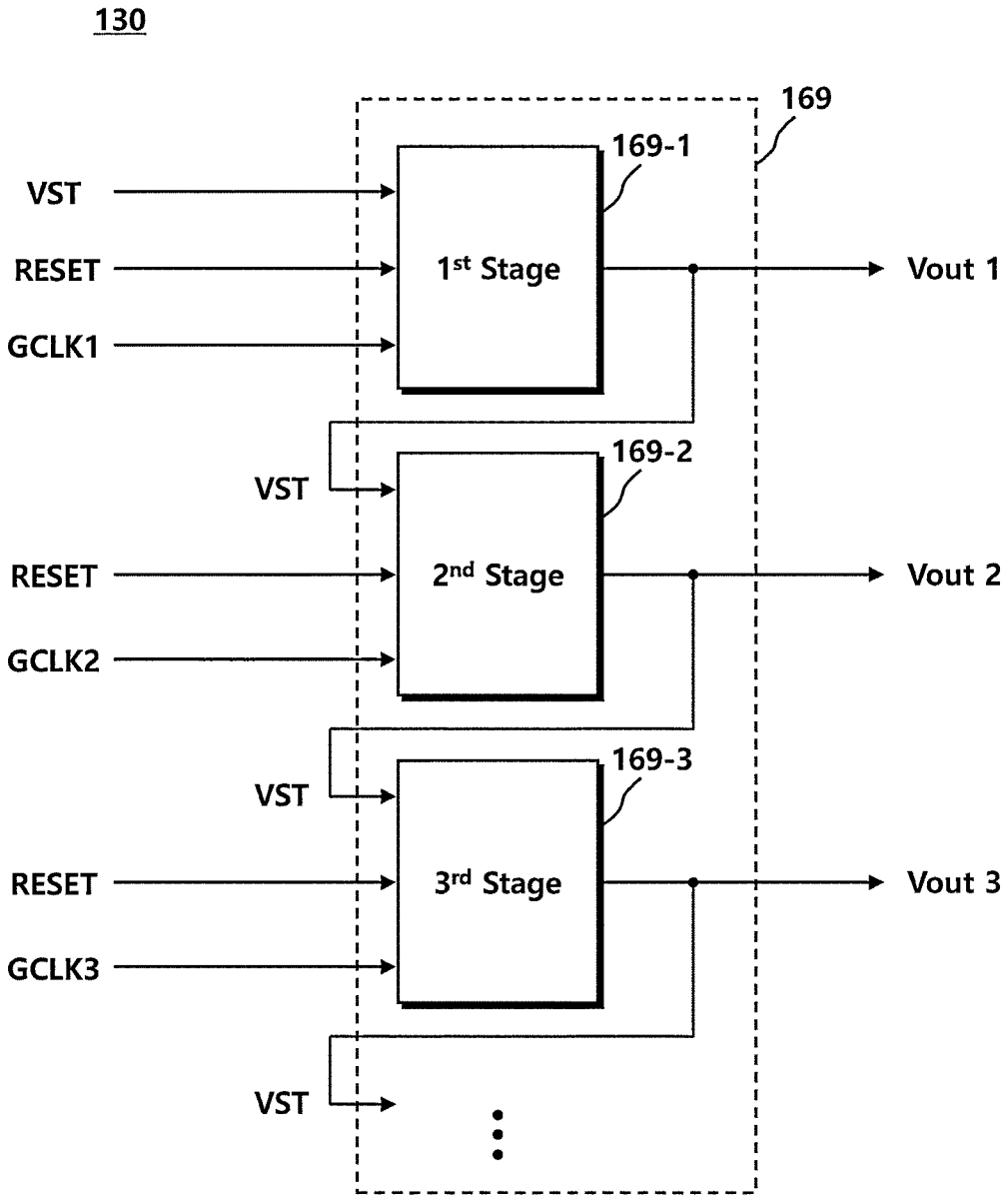
FIG. 5 is a diagram for explaining a gate output stage circuit in accordance with an embodiment.

FIG. 5 is a diagram for explaining a gate output stage circuit in accordance with an embodiment.

Referring to FIG. 5, the gate driving circuit 130 may include a gate output stage circuit 169.

The gate driving circuit 130 may receive the plurality of signals VST, RESET and GCLK1 to GCLK4 generated by the power management integrated circuit 160, and thereby, may transfer a gate voltage to the plurality of gate lines.

The gate output stage circuit 169 may be a group in which a plurality of gate output stages are sequentially connected, and, according to the necessity, may include N (N is a natural number equal to or greater than 1) number of gate output stages. In addition, according to the necessity, the gate output stage circuit 169 may further include at least one gate output stage which drives a dummy logic.

The gate output stage circuit 169 may sequentially receive a plurality of gate clock signals each of which is generated by a combination of the on-clock signal ON_CLK and the off-clock signal OFF_CLK.

A first gate output stage 169-1 may determine a start time point of gate driving by receiving the gate start signal VST, may determine an end time point or an initialization time point of gate driving by receiving the gate reset signal RESET, and may transfer a gate driving voltage to a gate line which is connected to the output terminal of the first gate output stage 169-1.

The first gate output stage 169-1 may determine an output time point of the gate driving circuit by receiving the first gate clock signal GCLK1.

An output voltage Vout of the plurality of gate output stages may be used as a start signal of a next gate output stage. For example, a first voltage Vout 1 outputted from the first gate output stage 169-1 may be transferred to a second gate output stage 169-2, and may be used as the gate start signal VST.

As illustrated in FIG. 5, each of the first gate output stage 169-1 to a third gate output stage 169-3 may output the output voltage Vout in conjunction with the output timing of a previous gate output stage. In this case, the output voltage Vout 1 of the first gate output stage 169-1 may be transferred to the second gate output stage 169-2 and be used as the gate start signal VST, and an output voltage Vout 2 of the second gate output stage 169-2 may be transferred to the third gate output stage 169-3 and be used as the gate start signal VST.

The gate output stage circuit 169 may be defined as being included in the gate driving circuit 130, but, if necessary, may be defined as being included in the power management integrated circuit 160.

Figure 6:
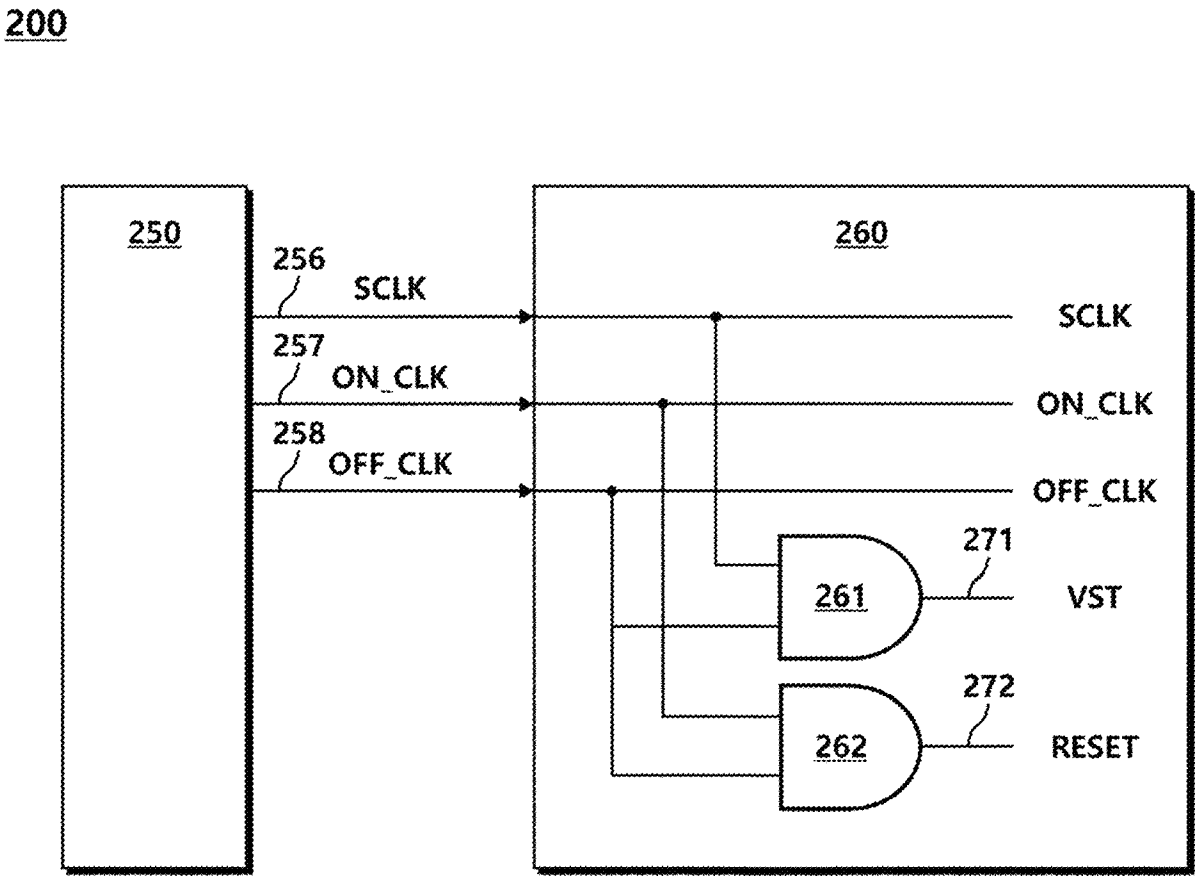
FIG. 6 is a diagram for explaining a conventional power management integrated circuit including an AND gate circuit.

FIG. 6 is a diagram for explaining a conventional power management integrated circuit including an AND gate circuit.

Referring to FIG. 6, a conventional display device 200 may include a timing controller 250 and a power management integrated circuit 260.

The power management integrated circuit 260 may receive a start clock signal SCLK for setting a driving start time point of a gate driving circuit, an on-clock signal ON_CLK for setting an output start time point of the gate driving circuit and an off-clock signal OFF_CLK for setting an output end time point of the gate driving circuit, which are generated by the timing controller 250, and may perform logic operations thereon.

The power management integrated circuit 260 may include a first AND gate circuit 261 which receives the start clock signal SCLK transferred through a start clock line 256 and the off-clock signal OFF_CLK transferred through an off-clock line 258. The first AND gate circuit 261 may generate a gate start signal VST and output it through a signal line 271 by performing an AND logic operation on the start clock signal SCLK and the off-clock signal OFF_CLK.

The gate start signal VST may be a signal which is transferred to a gate output stage circuit (not illustrated) to indicate an output start time point of the gate driving circuit.

The power management integrated circuit 260 may include a second AND gate circuit 262 which receives the on-clock signal ON_CLK transferred through an on-clock line 257 and the off-clock signal OFF_CLK transferred through the off-clock line 258. The second AND gate circuit 252 may generate a gate reset signal RESET and output it through a signal line 272 by logically calculating the on-clock signal ON_CLK and the off-clock signal OFF_CLK by performing an AND logic operation thereon.

The gate reset signal RESET may be a signal which is transferred to the gate output stage circuit (not illustrated) to indicate an output initialization time point of the gate driving circuit.

Since the input terminals of the first AND gate circuit 261 and the second AND gate circuit 262 are connected to the off-clock line 258, a time period cannot overlap with a gate clock signal GCLK generated by the on-clock signal ON_CLK and the off-clock signal OFF_CLK.

Figure 7:
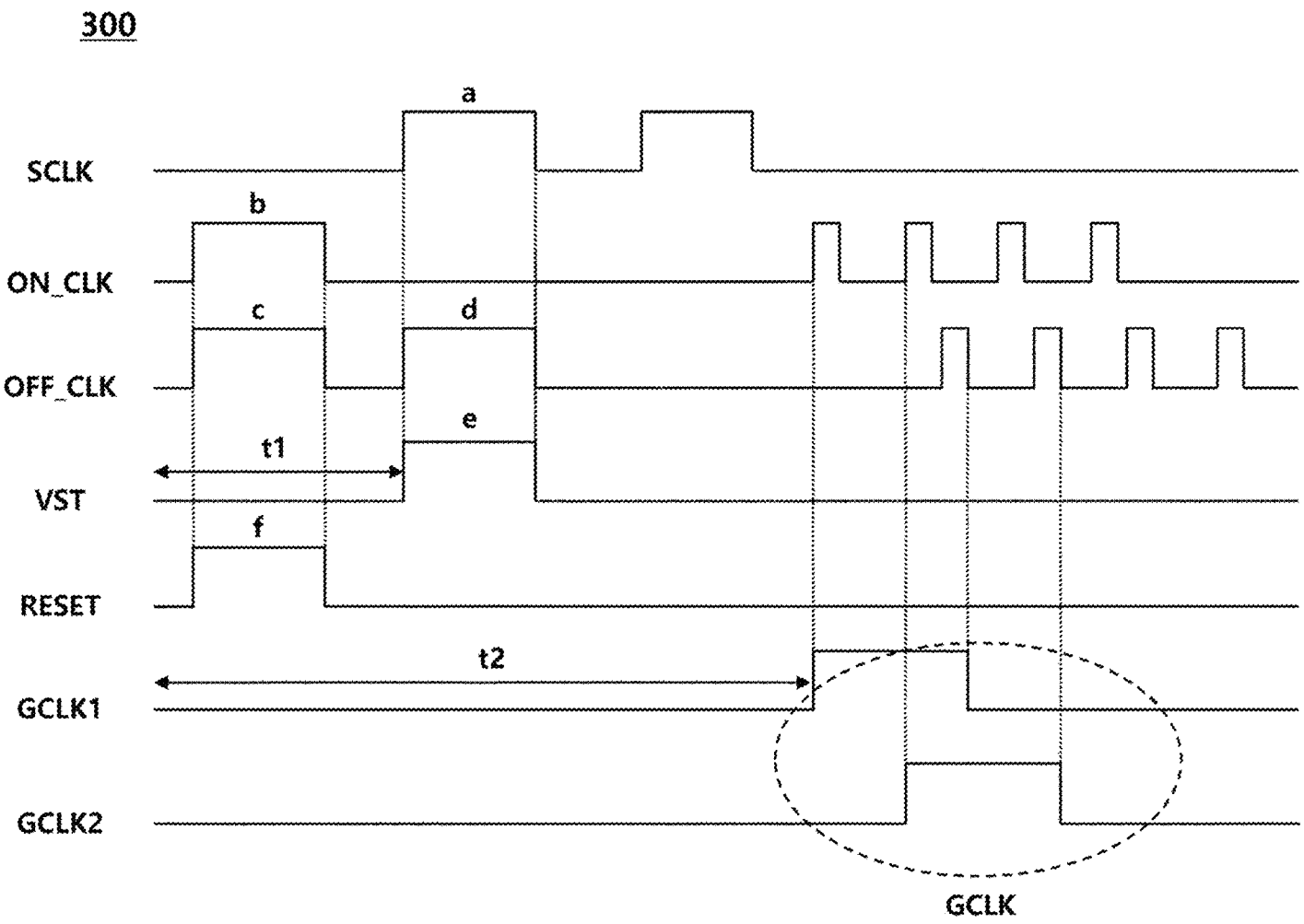
FIG. 7 is a timing diagram of signals supplied to the power management integrated circuit of FIG. 6.

FIG. 7 is a timing diagram of signals supplied to the power management integrated circuit of FIG. 6.

Referring to FIG. 7, a timing diagram 300 of the signals SCLK, ON_CLK and OFF_CLK supplied to the power management integrated circuit and the signals VST, RESET and GCLK generated by the power management integrated circuit is shown.

The start clock signal SCLK may include a plurality of pulses (for example, a time period of a high state may be defined as a pulse), and may include, for example, a first pulse a. The on-clock signal ON_CLK may include a plurality of pulses, and may include, for example, a second pulse b. The off-clock signal OFF_CLK may include a plurality of pulses, and may include, for example, a third pulse c and a fourth pulse d.

When the start clock signal SCLK, the on-clock signal ON_CLK and the off-clock signal OFF_CLK are transferred to the power management integrated circuit, the power management integrated circuit may generate the new gate control signals VST and RESET through the combination of the respective signals.

The power management integrated circuit may generate a fifth pulse e of the gate start signal VST by performing a logic operation on the first pulse a of the start clock signal SCLK and the fourth pulse d of the off-clock signal OFF_CLK through an AND gate circuit.

Also, the power management integrated circuit may generate a sixth pulse f of the gate reset signal RESET by performing a logic operation on the second pulse b of the on-clock signal ON_CLK and the third pulse c of the off-clock signal OFF_CLK through an AND gate circuit.

When a gate clock generation circuit (not illustrated) generates the gate clock signal GCLK by combining the on-clock signal ON_CLK and the off-clock signal OFF_CLK, an influence is exerted by the time periods of the gate start signal VST generated by the first AND gate circuit 261 and the gate reset signal RESET generated by the second AND gate circuit 262.

In this case, when the gate start signal VST is in a high state, the gate clock signal GCLK cannot be generated.

Time periods during which a plurality of gate clock signals GCLK1 and GCLK2 generated by the gate clock generation circuit (not illustrated) are generated cannot overlap with time periods during which the gate start signal VST and the gate reset signal RESET are generated, and the plurality of gate clock signals GCLK1 and GCLK2 are generated by the combination of the pulses of the separate on-clock signal ON_CLK and off-clock signal OFF_CLK supplied after the gate start signal VST and the gate reset signal RESET are generated. Therefore, the total driving time of the power management integrated circuit 260 and the gate driving circuit (not illustrated) increases.

In the case of a circuit configuration as illustrated in FIG. 7, a time t2 to a time point when the first gate clock signal GCLK1 is generated is longer than a time t1 to a time point when the gate start signal VST is generated.

As the size of a panel increases, in order to charge the load of the panel, high-state periods of the gate start signal VST, the gate reset signal RESET, the on-clock signal ON_CLK and the off-clock signal OFF_CLK increase. Therefore, there is a limitation in reducing the driving time of the panel.

If the operating frequency of one frame is increased in order for smooth screen display, the output periods of the gate start signal VST and the gate clock signal GCLK are shortened.

Figure 8:
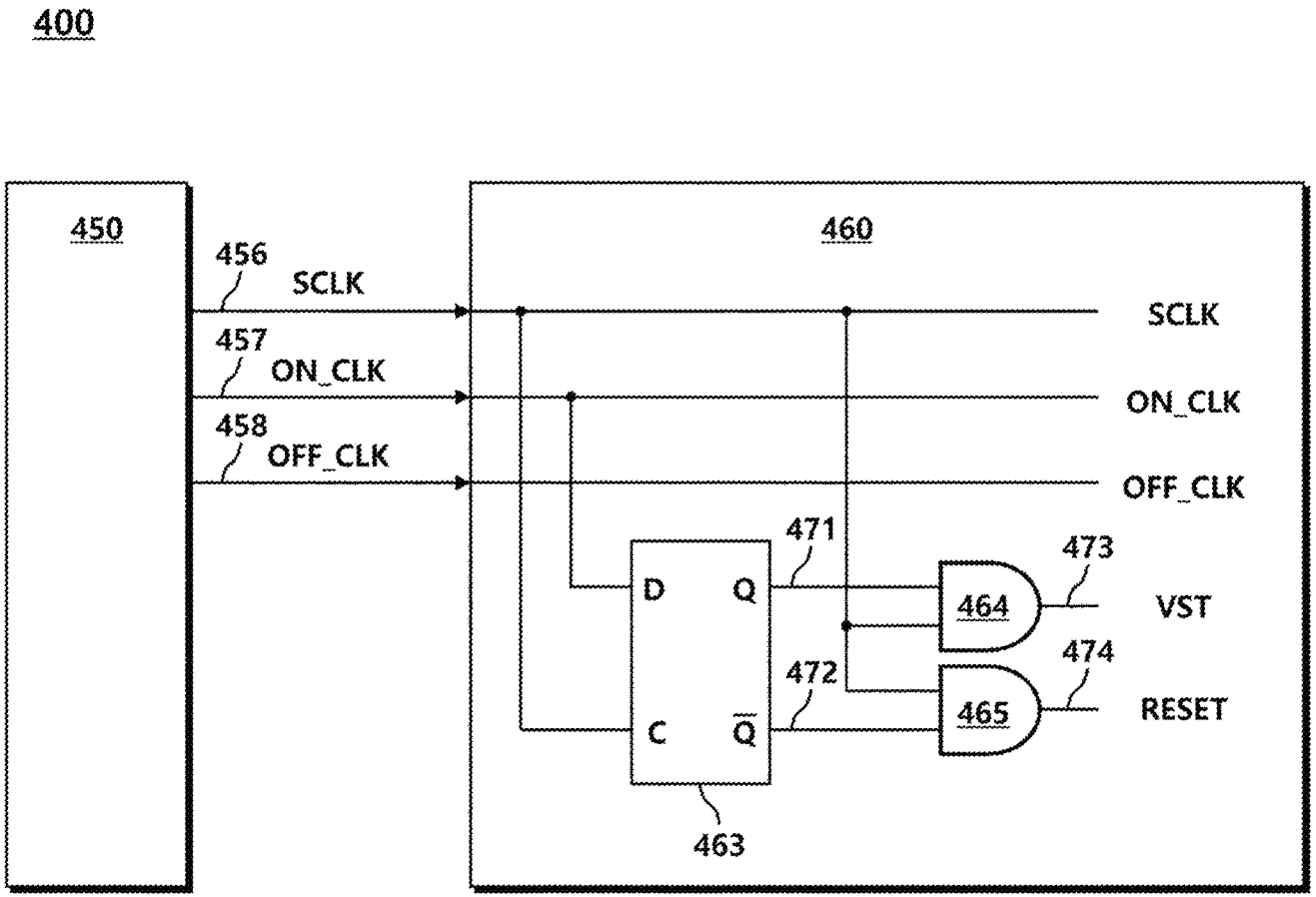
FIG. 8 is a diagram for explaining a power management integrated circuit including a flip-flop circuit and an AND gate circuit in accordance with an embodiment.

FIG. 8 is a diagram for explaining a power management integrated circuit including a flip-flop circuit and an AND gate circuit in accordance with an embodiment.

Referring to FIG. 8, a display device 400 may include a timing controller 450 and a power management integrated circuit 460.

The timing controller 450 may transfer a plurality of gate control signals SCLK, ON_CLK and OFF_CLK to the power management integrated circuit 460 through a plurality of signal lines or interfaces 456, 457 and 458 which are connected to the power management integrated circuit 460.

The power management integrated circuit 460 may include a flip-flop circuit 463, a first AND gate circuit 464 and a second AND gate circuit 465.

The flip-flop circuit 463 may receive a start clock signal SCLK for setting a driving start time point of a gate driving circuit and an on-clock signal ON_CLK for setting an output start time point of the gate driving circuit, and may perform logic operations thereon. If necessary, the flip-flop circuit 463 may be defined as a latch circuit.

The flip-flop circuit 463 may receive the on-clock signal ON_CLK through a first terminal (a D terminal) from an on-clock line 457, may receive the start clock signal SCLK through a second terminal (a C terminal) from a start clock line 456, and may be driven independently of an off-clock signal OFF_CLK for setting an output end time point of the gate driving circuit.

Figure 9:
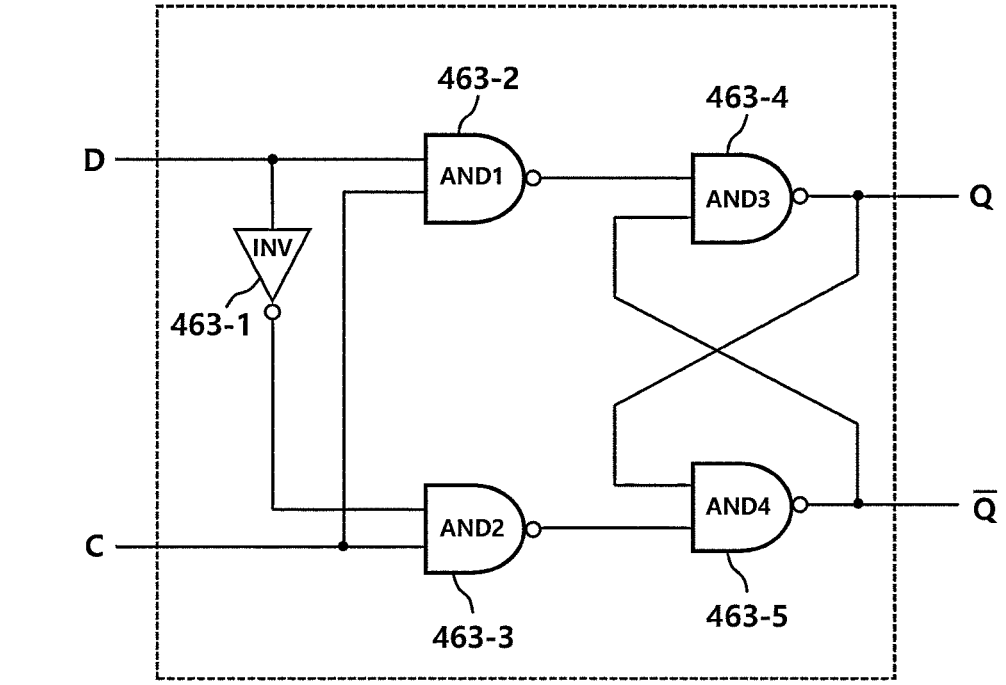
FIG. 9 is a diagram for explaining a D flip-flop circuit in accordance with an embodiment.

The flip-flop circuit 463 may be a D flip-flop circuit, illustrated in FIG. 9, including one inverter which receives the on-clock signal ON_CLK and transfers the on-clock signal ON_CLK to an internal AND gate circuit and four AND gate circuits which calculate the on-clock signal ON_CLK and the start clock signal SCLK.

The first AND gate circuit 464 may generate a gate start signal VST as a result of receiving one of the output signals of the flip-flop circuit 463 and the start clock signal SCLK through separate signal lines and then performing an AND logic operation thereon and output it through a signal line 473.

The second AND gate circuit 465 may generate a gate reset signal RESET by receiving another one of the output signals of the flip-flop circuit 463 and the start clock signal SCLK and performing an AND logic operation thereon and may output it through a signal line 474.

The input terminals of the first AND gate circuit 464 and the second AND gate circuit 465 may form a common node to receive the start clock signal SCLK. In this case, the interval and waveform of the pulses inputted to the common node may be the same.

The input terminals of the first AND gate circuit 464 and the second AND gate circuit 465 may form separate signal lines 471 and 472 to be connected to the flip-flop circuit 463.

The gate start signal VST and the gate reset signal RESET which are outputted from the first AND gate circuit 464 and the second AND gate circuit 465 may be ones which are not be generated by an external device, for example, the timing controller 450, but are generated by the power management integrated circuit 460 itself.

The gate start signal VST transferred through the output terminal of the first AND gate circuit 464 and the gate reset signal RESET transferred through the output terminal of the second AND gate circuit 465 may be connected to a gate output stage (not illustrated) which supplies a gate driving voltage Vout to a plurality of gate lines GL.

Signals which are transferred to the flip-flop circuit 463, the first AND gate circuit 464 and the second AND gate circuit 465 may be ones which are transferred through branched signal lines other than the signal lines extending from the timing controller 450.

At least one circuit among the flip-flop circuit 463, the first AND gate circuit 464 and the second AND gate circuit 465 may be defined as a logic combination circuit.

As signals which are transferred through the signal lines 456, 457 and 458 from the timing controller 450 may be transferred to a gate clock generation circuit (not illustrated) in a form in which the waveforms and timing of the signals are not changed by the logic combination circuit to generate a gate clock signal GCLK.

The gate clock generation circuit (not illustrated) may generate the gate clock signal GCLK by the combination of the on-clock signal ON_CLK and the off-clock signal OFF_CLK, and the gate clock signal GCLK may be generated independently of the gate start signal VST or the gate reset signal RESET.

Since the gate clock signal GCLK and the gate start signal VST or the gate reset signal RESET may be simultaneously driven such that the time period of the gate clock signal GCLK overlaps partly or entirely with the time period of the gate start signal VST or the gate reset signal RESET, the total driving time of the gate driving circuit (not illustrated) or the power management integrated circuit 460 may be reduced, and thus, the total driving time of the display device 400 may also be reduced.

The gate clock signal GCLK may be generated by combining the rising edge of the on-clock signal ON_CLK and the falling edge of the off-clock signal OFF_CLK according to a preset rule.

FIG. 9 is a diagram for explaining a flip-flop circuit in accordance with an embodiment.

Referring to FIG. 9, the flip-flop circuit 463 may be a D flip-flop circuit which includes one inverter 463-1 and four AND gate circuits 463-2 to 463-5, but is not limited thereto.

The flip-flop circuit 463 may receive the on-clock signal ON_CLK, generated by the timing controller 450, through a first input port (a D port), may receive the start clock signal SCLK, generated by the timing controller 450, through a second input port (a C port), and may perform a logic operation thereon.

The inverter 463-1 may be connected between the first input port (the D port) and the second AND gate circuit 463-3, may invert an input, and may output an inverted input.

Only a signal line may be connected to the second input port (the C port) and the first AND gate circuit 463-2 without a separate circuit element.

The output of the first AND gate circuit 463-2 may be inputted to the third AND gate circuit 463-4, and the output of the second AND gate circuit 463-3 may be inputted to the fourth AND gate circuit 463-5.

The flip-flop circuit 463 may output the output signal of the third AND gate circuit 463-4 to a first output port (a Q port), and the output of the third AND gate circuit 463-4 may also be transferred to the input terminal of the fourth AND gate circuit 463-5.

The flip-flop circuit 463 may output the output signal of the fourth AND gate circuit 463-5 to a second output port (an inverted Q port), and the output of the fourth AND gate circuit 463-5 may also be transferred to the input terminal of the third AND gate circuit 463-4.

The flip-flop circuit 463 of the above type may generate two output signals of opposite phases which are identified by the timing of the falling edge and the rising edge of the start clock signal SCLK and the on-clock signal ON_CLK, for example, timing at which a high level state and a low level state are changed.

The first AND gate circuit 464 may receive the start clock signal SCLK, may perform an AND logic operation on the start clock signal SCLK and an on-clock latch signal ON_CLK LATCH (see FIG. 10) outputted from the first output port (the Q port) of the flip-flop circuit 463, and may generate the gate start signal VST.

The second AND gate circuit 465 may receive the start clock signal SCLK, may perform an AND logic operation on the start clock signal SCLK and the signal outputted from the second output port (the inverted Q port) of the flip-flop circuit 463, and may generate the gate reset signal RESET.

The first AND gate circuit 464 and the second AND gate circuit 465 may form a common input terminal, and may receive the start clock signal SCLK through the common input terminal. In this case, one input terminal may receive the output of the flip-flop circuit 463, and the other input terminal may receive the start clock signal SCLK.

The output timing of the gate start signal VST generated by the first AND gate circuit 464 connected to the flip-flop circuit 463 and the output timing of the gate clock signal GCLK generated on the basis of the on-clock signal ON_CLK by the gate clock generation circuit (not illustrated), for example, rising edge timing or falling edge timing, may be independently determined.

Figure 10:
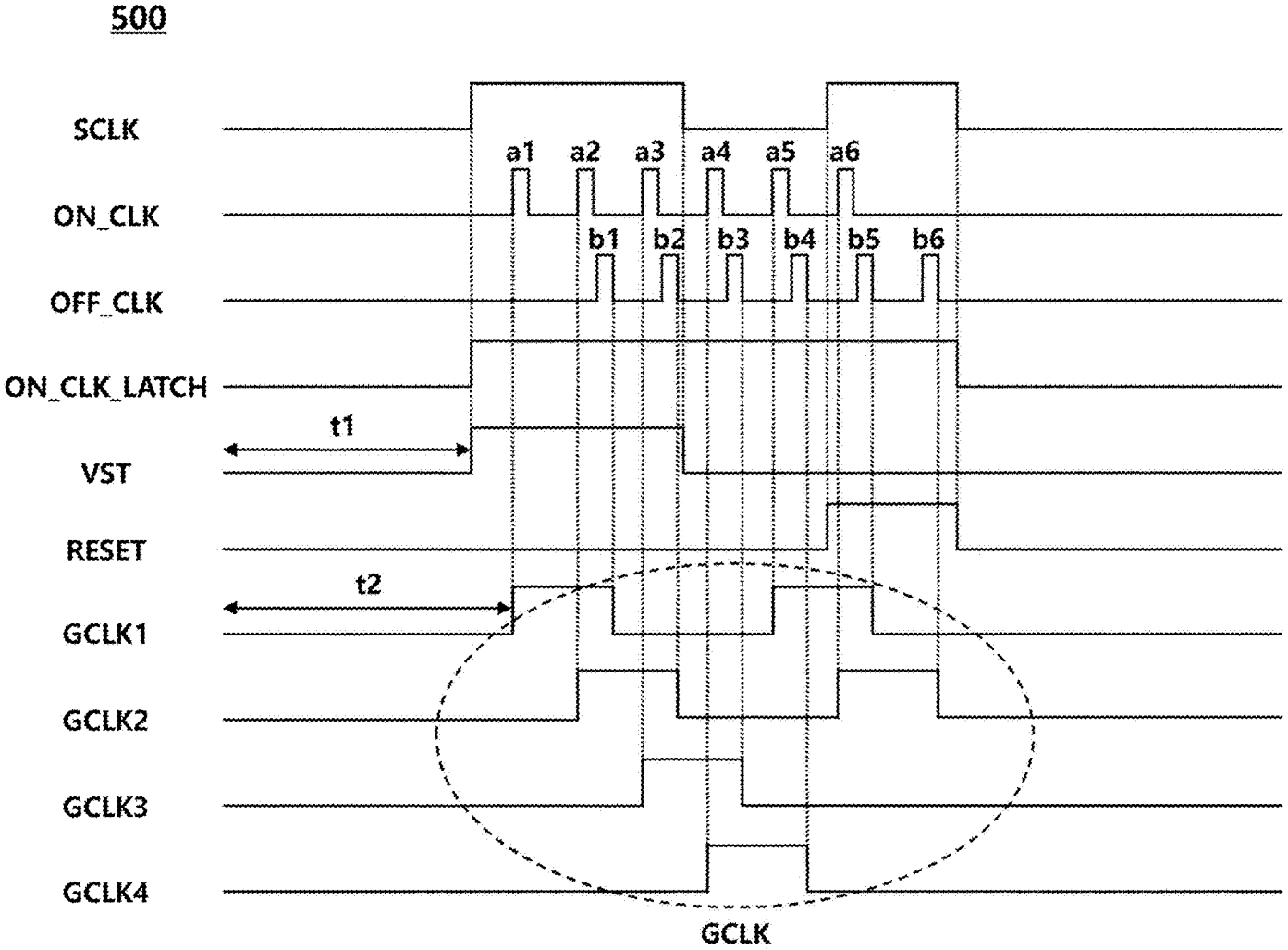
FIG. 10 is a timing diagram of signals supplied to the power management integrated circuit of FIG. 8.

FIG. 10 is a timing diagram of signals supplied to the power management integrated circuit of FIG. 8.

Referring to FIG. 10, a timing diagram 500 of the signals SCLK, ON_CLK and OFF_CLK supplied to the power management integrated circuit 460 and the signals ON_CLK LATCH, VST, RESET and GCLK generated by the power management integrated circuit 460 is shown.

Referring to FIG. 8, since the gate start signal VST and gate clock signals GCLK1 to GCLK4 may be independently driven by a plurality of AND gate circuits connected to the flip-flop circuit 463, time periods may overlap with each other. In this case, since the operation times of the timing controller 450, the power management integrated circuit 460 and the gate driving circuit may be reduced, the display device 400 may efficiently control operations. For example, when 1080 gate lines are formed, since the driving time of 270 gate lines formed in each of four blocks may be reduced, clock operation times to be repeated may be efficiently managed.

The timing controller 450 may transfer the plurality of gate control signals SCLK, ON_CLK and OFF_CLK to the power management integrated circuit 460.

The power management integrated circuit 460 may include a flip-flop circuit (FF) 463 which logically calculates the start clock signal SCLK and the on-clock signal ON_CLK for each time period. The flip-flop circuit 463 may include a D flip-flop circuit, and the D flip-flop circuit may serve to electrically isolate the off-clock signal OFF_CLK, the gate start signal VST and the gate reset signal RESET.

The on-clock latch signal ON_CLK LATCH, which is generated through the flip-flop circuit 463, and the gate start signal VST, which is generated by combining the on-clock latch signal ON_CLK LATCH and the start clock signal SCLK through the AND gate circuit 464, may be independently generated at timing that is regardless of the off-clock signal OFF_CLK.

Rising timing t1 of the gate start signal VST which is generated through the flip-flop circuit 463 and the AND gate circuit 464 and rising timing t2 of a first gate clock signal GCLK1 may be independently controlled, and the time periods of all or some of the gate clock signals GCLK may overlap.

The gate clock generation circuit (not illustrated) my generate the plurality of gate clock signals GCLK1 to GCLK4 on the basis of the rising edge timing of a plurality of on-clock signals ON_CLK and the falling edge timing of a plurality of off-clock signals OFF_CLK. However, the pulse widths, kinds and numbers of the gate clock signals GCLK are not limited thereto, and may be differently set according to a system condition.

For example, the gate clock generation circuit (not illustrated) may generate the gate clock signals GCLK by selecting the rising edge timing of some among pulses a1, a2, a3, a4, a5 and a6 of the plurality of on-clock signals ON_CLK and selecting the falling edge timing of some among pulses b1, b2, b3, b4, b5 and b6 of the plurality of off-clock signals OFF_CLK.

For another example, the gate clock generation circuit (not illustrated) may generate the first gate clock signal GCLK1 corresponding to a time period from the rising timing of a first pulse a1 of the on-clock signal ON_CLK to the falling timing of a second pulse b1 of the off-clock signal OFF_CLK, and a cycle may be set to sequentially generate pulses having four phases.

In this case, even when the gate start signal VST is in a high state, the gate clock signals GCLK may be generated.

The gate clock signal GCLK may be generated during a signal generation period of the start clock signal SCLK or the gate start signal VST. By defining timing, at which the gate clock signal GCLK is generated, as a time period during which the start clock signal SCLK or the gate start signal VST is activated, the operation of the display device 400 may be variously defined.

Timing at which the gate clock signal GCLK is generated may be timing that causes the time period of the gate clock signal GCLK to overlap with the entirety or a part of the signal generation time period of the start clock signal SCLK or the gate start signal VST. When the gate clock signal GCLK includes a plurality of pulses, the output time period of the gate clock signal GCLK may be determined such that at least one pulse overlaps with the entirety or a part of the signal generation time period of the start clock signal SCLK or the gate start signal VST.

The generation timing of the gate clock signal GCLK may be defined as timing at which the rising edge of the gate clock signal GCLK is generated.

A gate output stage circuit (not illustrated) may receive the output signal of an AND gate circuit and transfer a gate driving voltage to a gate line, and may include a plurality of gate output stages which are connected to a plurality of gate lines.

In this case, since the gate clock signal GCLK may be generated even when the gate start signal VST is in a high state, the operation time of the gate output stage circuit (not illustrated) may be reduced.

The above-described waveforms, numbers and timing of clock signals are to describe the technical features of the present disclosure. However, the present disclosure is not limited thereto, and waveforms, numbers and timing of clock signals may be variously changed according to a driving condition of a panel.

What is claimed is:

1. A power management integrated circuit comprising:

a flip-flop circuit configured to perform a logic operation on a start clock signal which sets a driving start time point of a gate driving circuit and an on-clock signal which sets an output start time point of the gate driving circuit;

a first AND gate circuit configured to receive one among output signals of the flip-flop circuit and the start clock signal, to perform an AND logic operation thereon, and to generate a gate start signal; and a second AND gate circuit configured to receive the other of the output signals of the flip-flop circuit and the start clock signal, to perform an AND logic operation thereon, and to generate a gate reset signal.

2. The power management integrated circuit according to claim 1, wherein the flip-flop circuit receives the start clock signal by a first terminal through a start clock line, receives the on-clock signal by a second terminal through an on-clock line, and is controlled independently of an off-clock signal which sets an output end time point of the gate driving circuit.

3. The power management integrated circuit according to claim 1, wherein the flip-flop circuit is a D flip-flop circuit comprising one inverter, which receives the on-clock signal and transfers the on-clock signal to an internal AND gate circuit, and four AND gate circuits, which perform operations on the on-clock signal and the start clock signal.

4. The power management integrated circuit according to claim 1, wherein input terminals of the first AND gate circuit and the second AND gate circuit receive the start clock signal by forming a common node.

5. The power management integrated circuit according to claim 1, further comprising:

a gate output stage configured to receive the gate start signal and the gate reset signal and to supply a gate driving voltage to a plurality of gate lines.

6. The power management integrated circuit according to claim 1, further comprising:

a gate clock generation circuit configured to generate a gate clock signal by using a rising edge of the on-clock signal and a falling edge of the off-clock signal.

7. The power management integrated circuit according to claim 1, wherein the gate clock signal, generated by a combination of the on-clock signal and the off-clock signal, is generated independently of the gate start signal.

8. The power management integrated circuit according to claim 1, wherein a part of a time period of the gate clock signal, generated by a combination of the on-clock signal and the off-clock signal, overlaps a time period of the gate start signal.

9. A power management integrated circuit comprising:

a D flip-flop circuit configured to receive, through a first input port, an on-clock signal generated by a timing controller, to receive, through a second input port, a start clock signal generated by the timing controller, and to perform a logic operation thereon;

a first AND gate circuit connected to a first output port of the D flip-flop circuit and configured to output a gate start signal; and a second AND gate circuit connected to a second output port of the D flip-flop circuit and configured to output a gate reset signal, wherein the D flip-flop circuit filters and outputs a pulse of an input signal through an inverter and four AND gate circuits disposed therein, and wherein the second AND gate circuit is connected to an output port of the inverter, the third AND gate circuit is connected to an output port of the first AND gate circuit and an output port of the fourth AND gate circuit, and the fourth AND gate circuit is connected to an output port of the second AND gate circuit and an output port of the third AND gate circuit.

10. The power management integrated circuit according to claim 9, wherein the first AND gate circuit receives the start clock signal and generates the gate start signal by performing an AND logic operation on the start clock signal and an on-clock latch signal outputted from the first output port of the D flip-flop circuit.

11. The power management integrated circuit according to claim 9, wherein the second AND gate circuit receives the start clock signal and generates the gate reset signal by performing an AND logic operation on the start clock signal and a signal outputted from the second output port of the D flip-flop circuit.

12. The power management integrated circuit according to claim 9, wherein the first AND gate circuit and the second AND gate circuit form a common input terminal and receive the start clock signal through the common input terminal.

13. The power management integrated circuit according to claim 9, wherein the D flip-flop circuit generates two output signals, each one having a reverse phase to the other's, which are determined by timing of falling edges and rising edges of the start clock signal and the on-clock signal.

14. The power management integrated circuit according to claim 9, wherein output timing of the gate start signal generated by the first AND gate circuit and output timing of a gate clock signal generated by the on-clock signal are independently determined.

15. The power management integrated circuit according to claim 9, wherein the gate clock signal is generated by a logic operation on the on-clock signal and is generated during a signal generation period of the start clock signal.

16. A power management integrated circuit connected to a timing controller which generates a gate control signal and configured to receive the gate control signal, wherein the gate control signal includes a start clock signal which is transferred to the power management integrated circuit through a start clock line, an on-clock signal which is transferred to the power management integrated circuit through an on-clock line, and an off-clock signal which is transferred to the power management integrated circuit through an off-clock line, and wherein the power management integrated circuit comprises:

a flip-flop circuit configured to perform a logic operation on the start clock signal and the on-clock signal for each time period;

an AND gate circuit configured to perform a logic operation on an output signal of the flip-flop circuit and the start clock signal and to output a gate start signal; and a gate output stage circuit configured to receive an output signal of the AND gate circuit and to transfer a gate driving voltage to a gate line.

17. The power management integrated circuit according to claim 16, wherein the flip-flop circuit comprises a D flip-flop circuit and electrically isolates the off-clock signal and the gate start signal from each other by connecting an output terminal of the D flip-flop circuit to an input terminal of the AND gate circuit.

18. The power management integrated circuit according to claim 16, wherein a plurality of gate clock signals are generated on the basis of rising edge timing of the on-clock signal and falling edge timing of the off-clock signal.

19. The power management integrated circuit according to claim 16, wherein the gate output stage circuit comprises a plurality of gate output stages which are connected to a plurality of gate lines and an output voltage of each of the plurality of gate output stages is used as a start signal of a next gate output stage.

20. The power management integrated circuit according to claim 16, wherein the gate output stage circuit sequentially receives the plurality of gate clock signals which are generated by a combination of the on-clock signal and the off-clock signal.

* * * * *